United States Patent [19]

Hirt

[11] Patent Number: 4,680,004

[45] Date of Patent: Jul. 14, 1987

[54] METHOD AND APPARATUS FOR CONTROLLING GASOLINE VAPOR EMISSIONS

[75] Inventor: John H. Hirt, Fullerton, Calif.

[73] Assignee: Hirt Combustion Engineers, Montebello, Calif.

[21] Appl. No.: 836,097

[22] Filed: Mar. 4, 1986

[51] Int. Cl.[4] ..... F23G 7/06

[52] U.S. Cl. ..... 431/5; 431/202; 220/85 VR

[58] Field of Search ..... 431/5, 202, 43; 220/85 VR; 137/487.5; 141/59

[56] References Cited

U.S. PATENT DOCUMENTS

| | | | |
|---|---|---|---|
| 4,009,985 | 3/1977 | Hirt | 431/5 |
| 4,087,228 | 5/1978 | Datis | 431/5 |
| 4,435,150 | 3/1984 | Rippelmeyer | 431/43 |

*Primary Examiner*—Larry Jones
*Assistant Examiner*—Noah Kamen
*Attorney, Agent, or Firm*—Poms, Smith, Lande & Rose

[57] ABSTRACT

A method and apparatus for abatement of gasoline vapor emissions from a vent pipe at a gasoline service station in which a vapor piping system interconnects the vent pipe with gasoline storage tanks and gasoline dispensing nozzles in the service station, the apparatus including a pilot burner with a pilot ignitor, a main burner with a main burner ignitor, first and second vapor pressure switches in the vent pipe for sensing and controlling pressure of vapor in the vapor piping system to maintain the pressure of vapor slightly below atmospheric pressure, a regenerative small turbine located downstream from the first and second pressure switches for moving vapor in the vapor piping system; a sensor for the pressure of vapor downstream from said turbine for causing at a selected downstream pressure of vapor admission of vapor to the pilot burner, and a sensor for the pilot flame at the pilot burner for causing admission of vapor to the main burner for ignition by the pilot flame.

6 Claims, 2 Drawing Figures

METHOD AND APPARATUS FOR CONTROLLING GASOLINE VAPOR EMISSIONS

BACKGROUND OF THE INVENTION

Figure 1:
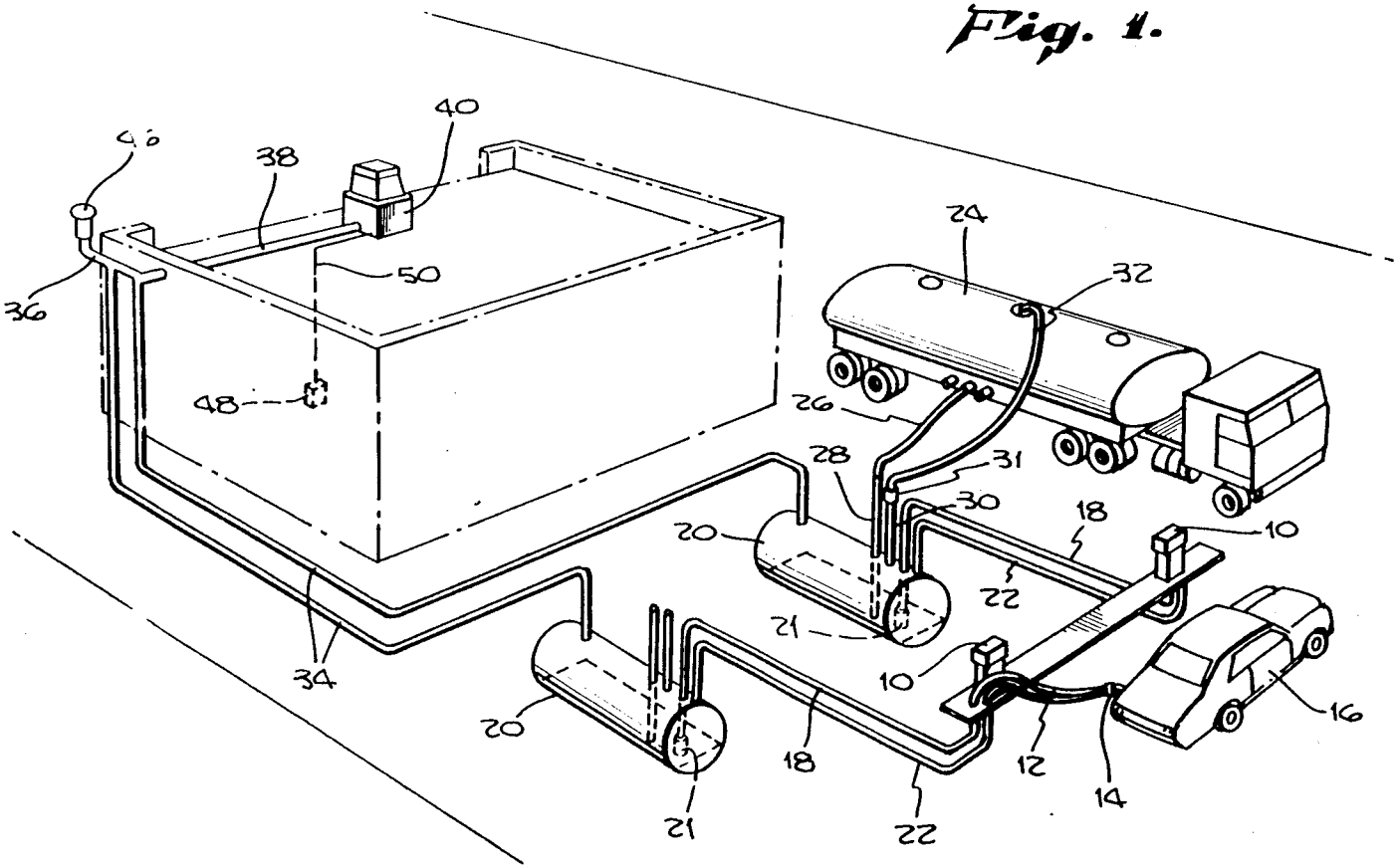

The present invention contemplates an improved method and apparatus for controlling gasoline vapor emissions at a service station or stations where liquid gasoline is transferred from one container or tank to another. The invention particularly relates to certain modifications and improvements in the apparatus and method of abatement of vapor emissions as described in U.S. Pat. Nos. 4,009,985; 4,118,170; and 4,292,020 owned by a common assignee.

Generally speaking the above three patents disclose an apparatus and method for controlling vapor emissions wherein the system preferably operates under a slight vacuum, is arranged to permit collected gasoline vapors in the system to recondense in the underground vapor storage containers, provides saturated vapors to blanket the stored liquid gasoline from air, thus preventing further evaporation of gasoline, provides vapors to replace gasoline dispensed, suppresses the formation of excess vapors, and thermally oxidizes any excess vapors in the system into carbon dioxide and water vapors which are clean, odorless, invisible and nonpolluting. Such patents describe multistage and single stage burners for disposing of the vapors, each burner being adapted to operate under certain specified conditions. The above three patents describe service station vapor emission conditions in detail and such description and subject matter of said patents are incorporated herein by reference.

In each of the above three patents the vapor emission control system described and included the use of compressed air which is readily available at a gasoline service station. However, the quality of the compressed air available at the many different gasoline service stations throughout the country was not uniform and in the past several years has significantly deteriorated. Such deterioration includes the presence of dirt, oil and water in the compressed air which, when used with a vapor emission controlled system utilizing compressed air, affected the vapor control system as described in the aforesaid three patents, compressed air from an air compressor was directed to an ejector where the compressed air through the ejector venturi created a vacuum and caused flow of vapor. Such flow of vapor induced by the compressed air created a vacuum in the vapor piping system of the service station, such vapor piping system including the vapor lines from the gasoline dispenser, the air space above the liquid level in the storage tanks, and the vent pipes for venting the tanks to atmosphere. In addition, in U.S. Pats. Nos. 4,292,020 and 4,118,170 compressed air and its presence in the system was required for actuation of valves opening the main flow of vapor to the main burner.

Further, since each gasoline service station is characterized by its own particular installation and in which distances between the gasoline dispensers and the gasoline storage containers and to the disposal means may vary and since such piping and fittings may develop underground difficult to locate air leaks, the mixture of the compressed air with a lean vapor mixture in the vapor piping system to provide a combustible mixture was sometimes difficult to obtain since the addition of compressed air to the already lean vapor mixture might result in a still leaner mixture which may or may not be combustible.

SUMMARY OF THE INVENTION

The present invention contemplates an apparatus and method for controlling gasoline vapor emissions which includes improvements in the apparatus and mode of operating a vapor emission control system at a service station. The present invention also contemplates improvements which reduce the amount of equipment required to maintain a selected vacuum in the service station vapor system and to effect complete burning of gasoline vapors. The invention provides a vapor gasoline emission system in which compressed air is not used. The present invention also includes a vapor emission control system which avoids many of the maintenance and repair problems of the prior systems and which may be readily retrofitted to existing vapor control systems.

Generally speaking, the present invention contemplates a vapor emission control system operable without compressed air. The invention contemplates a vacuum type gasoline vapor system in which the vapors in the vapor pipe system are maintained at a selected vacuum or below atmospheric pressure by use of a small regenerative type turbine means in the main vapor line downstream from the major portion of the vapor pipe system and from a pair of pressure vacuum switches.

It is therefore a primary object of the present invention to provide an improved apparatus and method for controlling vapor emissions at a gasoline service station.

An object of the present invention is to provide a vapor emission control system utilizing a turbine means which is activated upon the presence of a selected vacuum in the vapor piping system and which is deactivated or made inactive in the absence of a pilot flame at a pilot burner.

Another object of the invention is to provide an improved vapor control emission system which is readily adapted to prior proposed control systems including the systems of the above three patents and an installed balanced vapor system.

A still further object of the invention is to provide a vapor emission control system which is inexpensive and which does not require a filter, a catalyst, refrigerant, carbon bed, lubrication, refractory material, auxiliary fuel or an air compressor.

Additional objects and advantages of the present invention will be readily apparent from the following description of the drawings in which an exemplary embodiment of the invention is shown.

IN THE DRAWINGS

FIG. 1 is a schematic view of a gasoline service station illustrating transfer paths of liquid gasoline and gasoline vapors between the delivery tank truck and an underground storage tank and between the storage tank and an automobile tank through service station gasoline pumps and hoses, and the transfer of gasoline vapors through vent pipes to a disposal means for disposing of excess gasoline vapors under certain conditions.

Figure 2:
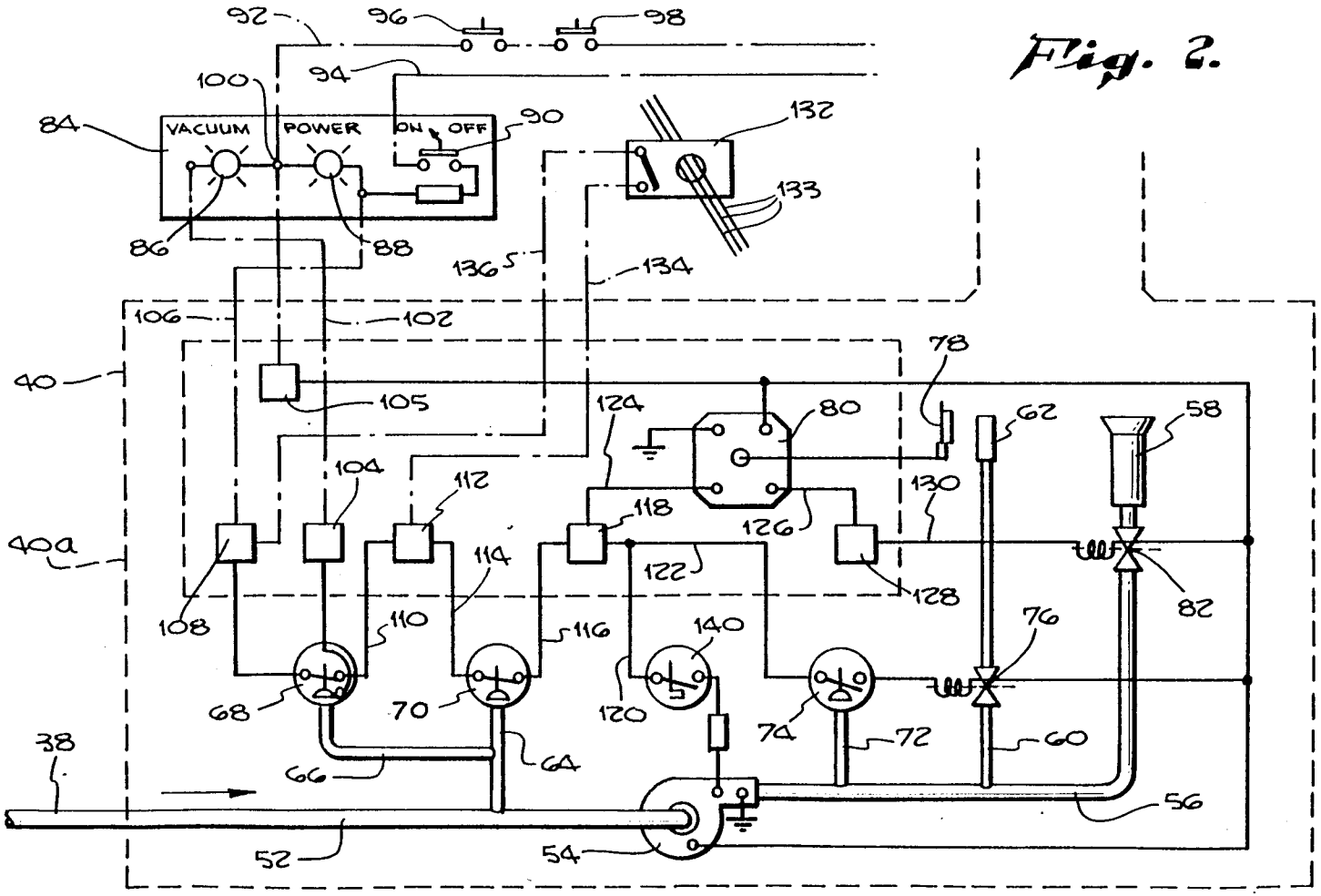

FIG. 2 is a schematic piping, instrument and electrical system embodying the present invention.

BRIEF DESCRIPTION OF THE PREFERRED EMBODIMENT

Referring first to FIG. 1, a gasoline service station is provided with facilities for storage and dispensing of liquid gasoline and for control and abatement of gasoline vapors by burning. In FIG. 1 a service station is shown with gasoline dispensers 10 each having a liquid gasoline dispensing hose means 12 provided with a nozzle 14 for insertion into a fill pipe of a gasoline tank of vehicle 16. Hose means 12 includes two hose lines connected to nozzle 14, one hose line providing for passage of liquid gasoline through pipe 18 from the storage tank 20 to dispensers 10 and to the nozzle 14. The other hose line provides for passage of gasoline vapors from the vehicle tank through pipe 22 to storage tank 20. Nozzle 14 may be either of vehicle fill pipe sealing or nonsealing type. A sealing type is a nozzle which has a flexible rubber boot which must be in sealed relation with a fill pipe before gasoline is dispensed. A nonsealing type approximates a fit with the vehicle fill pipe. Vapor line 22 discharges vapor from the vehicle tank into the upper part of the storage tank 20. The tanks 16 shown in FIG. 1 may be underground and each tank may have different levels of liquid gasoline therein depending upon the amount of liquid gasoline dispensed through their respective dispensers 10.

FIG. 1 also schematically illustrates the filling of underground tank or container 20 by gasoline tank truck 24 having a fuel line 26 entering underground tank 20 through an upstanding fill riser 28 which discharges liquid gasoline adjacent to the bottom of tank 20. Tank 20 also has an upstanding vent riser 30 which may be connected to a vapor return line 32 leading to the upper chamber portion of tank so that vapor from the underground tank 20 will be displaced and returned to the truck 24.

In each of the vehicle and truck liquid gasoline transfer systems generally described above, the pipe and hose couplings and lines are so constructed as to provide a closed substantially vapor tight system for liquid gasoline and also for gasoline vapors present in the system. Such transfer of gasoline vapors and liquids under a closed vapor system prevents loss of gasoline vapors to atmosphere at fill nozzle 14 and at the fill coupling 31 of the tank truck 24 to the underground tank 20. Gasoline vapors accumulating in upper portions of the underground storage tank 20 may flow through vent pipes 34 to a manifold at 36 and then through vent pipe 38 to the processor unit 40. Under conditions of nondispensing of gasoline from service dispensers 10 or nonfilling of the tanks by the tank truck 24, the vapor piping system or that which contains gasoline vapors includes the space above the liquid level in each of the tanks 20, the vent pipes 34 leading from said tanks 20 to the manifold 36, vent pipe 38 and the vapor carrying pipes in the processor unit 40. Under conditions of filling the tanks 20 by tank truck 24, the vapor piping system would include the vapor return line 32. In the dispensing of gasoline to a vehicle 16 the vapor piping system would include vapor line 22. It will also be understood that the lines 22, tanks 20, vent lines 34 and possibly the manifold 36 may be buried in the ground and not readily inspected. Such underground lines and tanks 20 may develop leaks of various size which, if the vapor pipe system is under atmospheric or greater pressure, will result in seepage of gasoline into the ground. In the case of the present vacuum imposed system on such a vapor piping system, the presence of leaks may admit ambient air into the vapor system in small amounts.

The processor unit 40 may be installed on top of the service station as illustrated in said patents. Adjacent manifold 36 may be a pressure vacuum valve 46 in communication with manifold 36. Preferably the horizontally disposed vent pipe 38 is pitched away from the processor unit 40 so that condensate which may occur in pipe 38 will be drained toward the manifold and the tanks 20. A remote control panel 48 may be located in the service station building, the remote control panel 48 being connected to the processor unit 40 by suitable cable 50.

FIG. 2 shows a schematic piping, instrument and electrical circuit diagram which includes the processor unit contained within a processor housing **40*a* indicated in double dash phantom lines. Vapors from the vapor system are conducted into the processor housing 40*a* by the vent pipe or line 38. The path of the vapors is indicated in FIG. 2 by relatively heavy double lines. Vent line 38 is connected to vapor conducting pipe 52 in the processor housing and conducts such vapor to a turbine means 54**.

Turbine means 54 may be a small regenerative turbine as for example a model made and distributed by EG&G Company of Saugertes, N.Y. Such an exemplary turbine utilizes a fractional (such as a 1/16 or $\frac{1}{8}$) horsepower motor and is capable of moving $2\frac{1}{4}$ cubic feet per minute at 1 pound pressure per square inch. Turbine means 54 has capacity for quickly moving the vapor through the vapor piping system and is quickly responsive to changes from selected vacuum conditions in the vapor piping system. Downstream of turbine means 54, vapor pipe 56 conducts the discharge vapor to a main burner 58 and by a pipe 60 connected to pipe 56 upstream from the main burner, vapor is conducted to a pilot means 62.

Means for sensing the vacuum condition in the vapor system includes a vapor pipe 64 connected to pipe 52 upstream from turbine means 54. Connected to pipe 64 may be a vapor pipe 66. Vapor pipe 66 communicates with a first normally closed pressure switch means 68. Vapor pipe 64 is connected with a second normally closed pressure switch means 70. Pressure switches 68 and 70 function in a manner similar to the vacuum sensing switches in the above-identified three patents. Switch means 68 and 70 are adapted to turn the turbine means 54 on and off in order to maintain a predetermined vacuum such as 0.1 or 0.2 inches water column in the vapor pipe system of the service station.

Downstream of the turbine means 54 a vapor line 72 is connected to the vapor pipe 56. Vapor line 72 is connected to a third normally open pressure switch means 74. Pressure switch 74 senses the pressure generated by the turbine in pipe line 56 when the turbine is actuated. When a selected pressure such as 5 inches water column exists in the line 56, pressure switch 74 closes and causes actuation of pilot solenoid valve 76 provided in pilot vapor line 60. Opening of the pilot solenoid valve 76 feeds vapor to pilot means 62. Vapor at the pilot 62 is ignited by an ignitor sensor means 78 which is connected to an ignitor sensor module 80.

If the vapor at the pilot burner 62 is within its combustible range, it will be ignited by the spark in the ignitor sensor 78. A pilot flame existing at the ignitor sensor 78 will cause the ignitor sensor module 80 to complete the circuit to open the main solenoid valve means 82 to admit vapor from the vapor pipe 56 to the main burner 58. The flame at the pilot burner will thus ignite the vapors in the main burner 58.

The pressure switches 68 and 70 continually sense the vacuum condition in the entire vapor piping system with which the vapor line 38 has vapor communication.

If the vacuum condition in the vapor system falls below a preset amount, as for example 0.1 inches of water column, as sensed by vacuum switch 68, switch 68 energizes the turbine means and the ignition system, the spark probe, the pilot burner and ultimately the main burner.

Switch 68 is connected to control panel 84 which includes a vacuum indicating lamp 86, a power off and on light 88, and an on and off switch 90. The control panel is connected to a pair of current leads 92 and 94 which are connected to a suitable power source and includes a station master switch 96, an emergency pump shutdown switch, and short circuit protection 98.

When the on and off switch 90 is in closed position, the power lamp 88 is illuminated by the completion of the circuit between lines 94 through the on-off switch and lead 92 at the connection 100 in the control panel. In the presence of a vacuum condition which activates the pressure switch 68, the lead 102 passing through terminal 104 to the switch 68 completes a circuit with lead 106 which passes through terminal 108 to the switch 68 and completes a circuit to cause illumination of the vacuum lamp 86 to indicate visually the presence of a selected vacuum condition in the vapor pipe system. The vacuum condition referred to is one which is different than the preset vacuum range as determined by the setting of the switches 68 and 70. In such a vacuum condition which requires the movement of excess vapors to the burner, the turbine means 54 is activated by the completion of a circuit through lines 110, terminal 112, and lines 114 leading to the switch means 70 and passing therethrough by line 116 through terminal 118 and line 120 to energize the turbine means 54. Line 122 from terminal 118 leads to the pressure switch 74 which when activated or closed by vapor draft pressure in line 56 will actuate the pilot solenoid valve 76 to admit vapor to the pilot burner. Also, the presence of current through terminal 118 and through lead 124 energizes the ignitor sensor module 80 for energizing the ignitor sensor 78. Thus, if the turbine 54 has been energized and is on, the pressure switch 74 senses the pressure in line 56 and admits through the pilot solenoid valve 76, vapor to the pilot 62 to produce a pilot flame when ignited by the ignitor 78. If there is a pilot flame under these conditions then the ignitor sensor module 80 energizes, through lines 126, terminal 128, and line 130, the main solenoid valve 82 to admit vapors from the main vapor line 56 to the main burner 58 for burning of the vapor.

When the vapor pressure has been brought to a preselected amount as determined by the switch 70, for example 0.5 inches water column, switch 70 will open and interrupt the current leading to the ignitor module 80, turbine means 54 and the pilot and main burners solenoid valves so that the system will shut down. When one or more of the gasoline pumps 21 are used to deliver gasoline to a vehicle tank, current is carried to those pumps in lines 133, causing a normally open current sensing relay 132 to close so that current is provided from terminal 108 through relay 132 through line 134 to terminal 112. and thus bypasses the pressure switch 68. Current is thus provided from terminal 112 through the pressure switch 70 to activate the turbine and the ignitor sensor module 80 as previously described.

In FIG. 2 a thermal switch 140 may be located between terminal 118 and the turbine 54. The thermal switch is normally closed and opens in the event of a fire in the processor housing 40A. The thermal switch has no relationship to the control of the turbine 54 except in the case of a fire.

It is important to note again that the pressure switch 74 which responds to the pressure of vapor on the discharge side of the turbine 54 assures that the turbine is in fact on before the pilot solenoid valve 76 is opened to provide vapor to the pilot burner.

In the operation of the control system described above, it should be noted that the full on-off sequence proceeds automatically and indefinitely unless or until the flow of electrical energy to the processor is switched off. A continuous pilot flame at the pilot burner 62 is not maintained. The pilot is ignited only when the vacuum conditions so require and burning of excess vapor is required. Further, the pressure switch 74 will not admit vapor through the pilot solenoid valve 76 from vapor line 56 unless the turbine means 54 is activated. The turbine 54 must be moving the vapor from line 52 and line 38 before the pilot burner can be ignited and thus before the main burner is ignited.

In the operation of the vapor control system described above, it will be readily apparent that the vapor control system is operable in the absence of any compressed air. The turbine means 54 does not introduce air into the system. The combustible mixture range is readily maintained because the introduction of air primarily occurs at the main burner. Thus, leaks in the components of the vapor piping system of the service station such as underground leaks at couplings, valves, and the like which might introduce air into the vapor system have little effect at the main burner where ambient air is mixed with vapor in usual burning practice. The vapor-air mixture being burned is more troublefree.

The advantages of the turbine means in the vapor control system described above are readily apparent to those skilled in the art. The turbine is not dependent on the existence, performance, or state of repair of an air compressor. It is not dependent upon the quality of compressed air available. The turbine system can tolerate more system leaks through which air is ingested because activation of the turbine means does not dilute vapor with air. It also eliminates the need for air actuated vapor valves which are sensitive to the condition of the compressed air and gasoline additives. The use of a turbine eliminates the need for the compressed air lines, ejector means, air pressure regulators, air filters, air moisture separators; and it is not necessary to maintain a continuous standing pilot flame. The indicator lamp 86 indicates whether or not a vacuum exists in the vapor piping. The pilot is intermittent depending upon the vapor conditions. The turbine processor is quieter which is of importance in service stations located in residential areas and the turbine means enables the design of a smaller processor which becomes important where space is at a premium, as at a service station.

Since the turbine means or the generating means for producing the vacuum is located downstream of all other vapor components in the gasoline station the turbine means can be small which not only reduces space requirements, but also provides a system having a reduced number of component parts and therefore reduced maintenance and service.

It will be understood that various changes and modifications may be made in the above described vapor control system which may come within the spirit of the invention and all such modifications coming within the scope of the claims are embraced thereby.

What is claimed is:

1. In an apparatus for abatement of gasoline vapor emissions from a vent pipe at a gasoline service station or the like in which a vapor piping system interconnects the vent pipe with gasoline storage tanks and gasoline dispensing nozzles in the service station, said apparatus including a pilot burner with pilot ignition means therefore, a main burner with main burner ignition means therefore, at least first and second vapor pressure switches in said vent pipe for sensing and controlling vapor pressure in said vapor piping system; the combination of:

turbine means located downstream from, and controllably activated by said first and second vapor pressure switches for moving vapor in the vapor piping system so as to maintain a partial vacuum in said vapor piping system;

means for sensing the vapor pressure downstream from said turbine means;

means responsive to said downstream vapor pressure sensing means for causing, at a selected vapor pressure downstream of said turbine means, admission of vapor to said pilot burner;

means for igniting said vapor at said pilot burner to provide a pilot flame;

means for sensing said pilot flame and upon sensing said pilot flame for causing admission of vapor to the main burner for ignition by said pilot flame.

2. An apparatus as claimed in claim 1 wherein said turbine means is of regenerative type.

3. An apparatus for abatement of gasoline vapor emissions at a gasoline service station or the like in which a vapor piping system interconnects the vent pipe with gasoline storage tanks and gasoline dispensing nozzles in the service station, said apparatus including a pilot burner with pilot ignition means, a main burner ignited by the flame of a pilot burner; at least first and second vapor sensing pressure switches in said vent pipe for sensing and controlling vapor pressure in said vapor piping system; the combination of:

turbine means located downstream from, and activated and deactivated by, said first and second pressure switches to maintain a selected vacuum in said vapor piping system;

a third pressure switch in the line between said turbine and said pilot burner;

a pilot vapor solenoid valve between said third pressure switch and said pilot burner and activated by said third pressure switch at a selected pressure after said turbine is activated to provide vapor flow to said pilot burner;

ignitor means for igniting vapor at said pilot burner to provide a pilot flame;

ignition relay means activated upon presence of a pilot flame;

and a main solenoid valve between said turbine means and said main burner and activated by said ignition relay means into open position to admit vapors to the main burner for ignition of said vapors by the pilot flame.

4. In a method of abating emissions from a gasoline service station in the absence of compressed air and in which a preselected vacuum is maintained and in which change of pressure of vapor in said vapor piping system from a preselected pressure of vapor causes actuation of a burner means for burning excess vapor, the improvement, comprising the steps of:

providing a vapor moving means in a vapor vent line of said vapor piping system to move said vapors in the absence of compressed air;

actuating said vapor moving means upon change of vapor pressure from a preselected pressure of vapor upstream from said vapor moving means; sensing a preselected pressure downstream from said vapor moving means causing flow of vapor to said pilot burner means in response to the sensed downstream preselected pressure;

activating said main burner means only upon presence of a flame in said pilot burner means;

and preventing flow of vapor to the main burner means and to the pilot burner in the absence of a selected pressure at the downstream side of the vapor moving means.

5. In an apparatus for abatement of gasoline vapor emissions at a gasoline service station or the like in which a vapor piping system interconnects a vent pipe with gasoline storage tanks and gasoline dispensing nozzles in the service station, said apparatus including a pilot burner with pilot ignition means, a main burner ignited by the flame of a pilot burner, at least first and second vapor sensing pressure switches in said vent pipe for sensing and controlling vapor pressure in said vapor piping system; the combination of:

vapor moving means downstream from said first and second vapor sensing switches and controlled thereby for maintaining a selected sub-atmospheric pressure in said vapor piping system;

a vapor conducting line from said vapor moving means to said pilot burner;

a third vapor sensing pressure switch in communication with said vapor conducting line downstream of said vapor moving means;

a vapor solenoid valve in communication with said vapor conducting line downstream of said third pressure sensing switch means; whereby sensing of a preselected pressure in said vapor line by said third pressure sensing switch causes activation of said vapor solenoid valve for providing flow of vapor to said pilot burner upon discharge of vapor from the downstream side of the vapor moving means at a preselected pressure.

6. In an apparatus as claimed in claim 5 including said vapor conducting line on the discharge side of said vapor moving means extending to the main burner;

a main burner solenoid valve in said extension of said vapor conducting line; and ignitor sensor means for activating the main vapor solenoid valve under pilot flame conditions of the pilot burner to admit vapors to the main burner.

* * * * *